US011856661B1

(12) United States Patent
Neuman et al.

(10) Patent No.: US 11,856,661 B1
(45) Date of Patent: Dec. 26, 2023

(54) FLEXIBLE HEATING ELEMENT

(71) Applicant: AUTOMATED ASSEMBLY CORPORATION, Lakeville, MN (US)

(72) Inventors: David Neuman, Randolph, MN (US); Pat Connolly, Burnsville, MN (US); Brian Backes, Lakeville, MN (US)

(73) Assignee: AUTOMATED ASSEMBLY CORPORATION, Lakeville, MN (US)

( * ) Notice: Subject to any disclaimer, the term of this patent is extended or adjusted under 35 U.S.C. 154(b) by 415 days.

(21) Appl. No.: 17/183,864

(22) Filed: Feb. 24, 2021

(51) Int. Cl.
*H05B 3/34* (2006.01)
*H05B 3/18* (2006.01)

(52) U.S. Cl.
CPC ..... *H05B 3/34* (2013.01); *H05B 3/18* (2013.01); *H05B 3/342* (2013.01); *H05B 3/347* (2013.01); *H05B 2203/002* (2013.01); *H05B 2203/003* (2013.01); *H05B 2203/007* (2013.01); *H05B 2203/011* (2013.01); *H05B 2203/014* (2013.01); *H05B 2203/029* (2013.01)

(58) Field of Classification Search
CPC ..... H05B 3/34; H05B 3/18; H05B 2203/002; H05B 2203/003; H05B 2203/007; H05B 2203/014; H05B 3/342; H05B 3/347; H05B 2203/011; H05B 2203/029
USPC ..... 219/443.1, 211, 212, 217, 528, 529, 219/542–549
See application file for complete search history.

(56) References Cited

U.S. PATENT DOCUMENTS 6,516,142 B2 2/2003 Grant et al.
6,744,978 B2 6/2004 Tweedy et al.
9,578,690 B2 * 2/2017 Howick ..... B60N 2/002
2003/0230565 A1 * 12/2003 Bikovsky ..... H05B 3/342 219/528
2005/0194378 A1 * 9/2005 Silva ..... F16L 53/38 219/544
2007/0007267 A1 * 1/2007 Rayl ..... H05B 3/34 219/217
2007/0278214 A1 * 12/2007 Weiss ..... H05B 3/342 219/545
2020/0015326 A1 * 1/2020 Gerster ..... H05B 3/347
2020/0263334 A1 * 8/2020 Mueller ..... H05B 3/345
2021/0402850 A1 * 12/2021 Devienne ..... H05B 3/34
(Continued)

FOREIGN PATENT DOCUMENTS

WO WO-2020249149 A1 * 12/2020 ..... B60N 2/5685

OTHER PUBLICATIONS

Machine English Translation of WO-2020249149-A1 (Year: 2020).*

*Primary Examiner* — Sang Y Paik
*Assistant Examiner* — Erwin J Wunderlich
(74) *Attorney, Agent, or Firm* — Crawford Maunu PLLC

(57) ABSTRACT

A heating element includes a flexible substrate, a layer of adhesive disposed on a surface of the substrate, and a continuous strand of electrically conductive wire disposed on the adhesive in a pattern of coil structures. Each coil structure includes a first coiled part and a second coiled part. The wire in the first coiled part forms a counterclockwise pattern from an outermost turn to an innermost turn of the first coiled part, and the second coiled part has an innermost turn beginning at an end of the innermost turn of the first coiled part. The wire in the second coiled part forms a clockwise pattern from the innermost turn of the second coiled part to an outermost turn. A connector segment of wire connects outermost turns of adjacent ones of the coil structures.

32 Claims, 7 Drawing Sheets

(56) References Cited

U.S. PATENT DOCUMENTS

| | | | | |
|---|---|---|---|---|
| 2022/0042639 | A1* | 2/2022 | Grande | H05B 3/18 |
| 2022/0227271 | A1* | 7/2022 | Tremmel | B60N 2/5685 |

* cited by examiner

FLEXIBLE HEATING ELEMENT

FIELD OF THE INVENTION

The disclosure generally relates to a heating element having multiple coil structures formed from a continuous strand of wire and disposed on a flexible substrate.

BACKGROUND

Heating elements are used in a variety of industries including consumer goods, energy, electronics, transportation, biomedical, military, and food service. The particular application generally dictates the form factor and operating parameters of the heating element. Commercial competition forces manufacturers to make heating elements that are economical, reliable, and lightweight. Thus, selection of materials, structure of the heating element, and methods of manufacture are critical decisions for the manufacturer.

SUMMARY

A disclosed heating element includes a flexible substrate having opposing first and second surfaces, a layer of adhesive disposed on the second surface of the substrate, and a continuous strand of electrically conductive wire disposed on the adhesive in a pattern of a plurality of coil structures. Each coil structure includes, respectively, a first coiled part and a second coiled part. The wire in the first coiled part forms a counterclockwise pattern from an outermost turn to an innermost turn of the first coiled part, and the second coiled part has an innermost turn beginning at an end of the innermost turn of the first coiled part. The wire in the second coiled part forms a clockwise pattern from the innermost turn of the second coiled part to an outermost turn of the second coiled part. For each of one or more first coil structures of the plurality of coil structures that is adjacent to a respective second coil structure of the plurality of coil structures, a connector segment of the wire connects an end portion of the outermost turn of the second coiled part of the first coil structure to an end portion of the outermost turn of the first coiled part of the respective second coil structure.

A disclosed roll of heating elements includes a flexible substrate having opposing first and second surfaces, an adhesive layer disposed on the second surface of the substrate, and a continuous strand of electrically conductive wire disposed on the second surface in a pattern of a plurality of coil structures. A release liner is adhered to the adhesive layer and covers the plurality of coil structures. Each coil structure includes, respectively, a first coiled part and a second coiled part. The wire in the first coiled part forms a counterclockwise pattern from an outermost turn to an innermost turn of the first coiled part, and the second coiled part has an innermost turn beginning at an end of the innermost turn of the first coiled part. The wire in the second coiled part forms a clockwise pattern from the innermost turn of the second coiled part to an outermost turn of the second coiled part. For each of one or more first coil structures of the plurality of coil structures that is adjacent to a respective second coil structure of the plurality of coil structures, a connector segment of the wire connects an end portion of the outermost turn of the second coiled part of the first coil structure to an end portion of the outermost turn of the first coiled part of the respective second coil structure. The flexible substrate, adhesive layer, and plurality of coil structures are coiled into a roll.

A disclosed method includes providing a roll of flexible substrate having opposing first and second surfaces and an adhesive layer disposed on the second surface and covered by a release liner. The method includes unwinding a portion of the roll, separating the release liner from the substrate as the portion of the roll is unwound, and laying a continuous strand of electrically conductive wire on the adhesive layer of the unwound portion in a pattern of a plurality of coil structures. Each coil structure includes, respectively, a first coiled part and a second coiled part. The wire in the first coiled part forms a counterclockwise pattern from an outermost turn to an innermost turn of the first coiled part, and the second coiled part has an innermost turn beginning at an end of the innermost turn of the first coiled part. The wire in the second coiled part forms a clockwise pattern from the innermost turn of the second coiled part to an outermost turn of the second coiled part. For each of one or more first coil structures of the plurality of coil structures that is adjacent to a respective second coil structure of the plurality of coil structures, a connector segment of the wire connects an end portion of the outermost turn of the second coiled part of the first coil structure to an end portion of the outermost turn of the first coiled part of the respective second coil structure. The method includes rewinding the unwound portion of the roll and reattaching the release liner to the adhesive layer as the roll is rewound.

The above summary of the present invention is not intended to describe each disclosed embodiment of the present invention. The figures and detailed description that follow provide additional example embodiments and aspects of the present invention.

BRIEF DESCRIPTION OF THE DRAWINGS

Other aspects and advantages of the invention will become apparent upon review of the Detailed Description and upon reference to the drawings in which.

DETAILED DESCRIPTION

Figure 1:
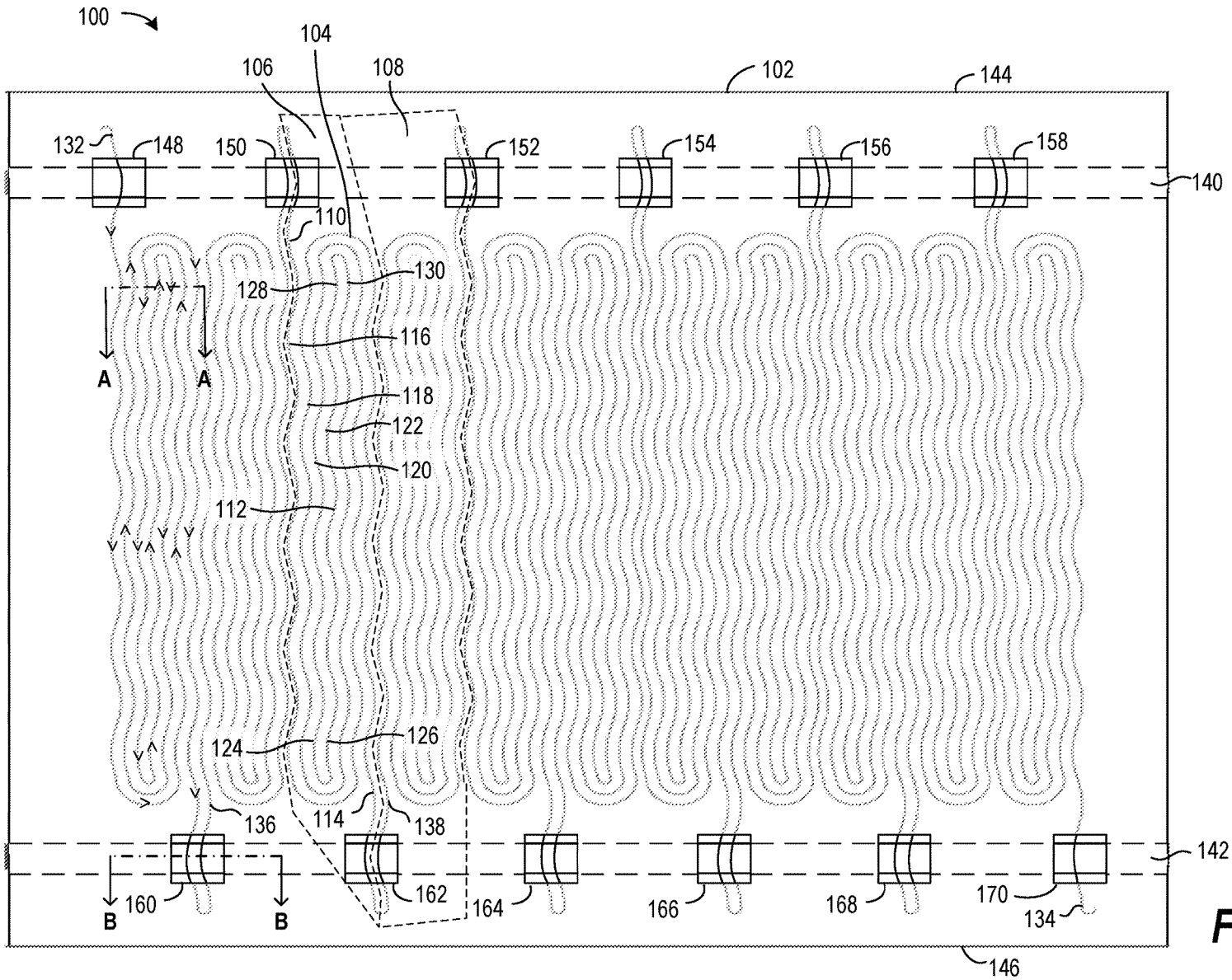
FIG. 1 shows a front-side view of a heating element 100 according to one example.

In the following description, numerous specific details are set forth to describe specific examples presented herein. It should be apparent, however, to one skilled in the art, that one or more other examples and/or variations of these examples may be practiced without all the specific details given below. In other instances, well known features have not been described in detail so as not to obscure the description of the examples herein. For ease of illustration, the same reference numerals may be used in different diagrams to refer to the same elements or additional instances of the same element. Terms such as over, under, top, bottom, above, below, front, back, etc. may be used herein to refer to relative positions of elements as shown in the figures. It should be understood that the terminology is used for notational convenience only and that in actual use the disclosed structures may be oriented different from the orientation shown in the figures. Thus, the terms should not be construed in a limiting manner.

The disclosed approaches are readily adaptable to making heating elements having a wide range of sizes and voltage levels. The heating elements can be formed on a roll-to-roll web, enabling construction of heating elements of a wide range of footprints and voltage levels, subject to the width and length of the substrate. The disclosed structures can be made using inexpensive and environmentally clean approaches. Low-cost materials and processes that require fewer environmentally hazardous chemicals than prior approaches are employed to create a heating element that is reliable, economical, and lightweight. The disclosed approaches involve a continuous pattern of electrically conductive wire on an adhesive layer of a substrate.

An exemplary heating element includes a flexible substrate having a layer of pressure-sensitive adhesive disposed on one of the surfaces of the substrate. Multiple coil structures are disposed on the layer of adhesive. The coil structures are comprised of a continuous strand of electrically conductive wire. Each coil structure includes a first coiled part and a second coiled part. The first coiled part has a counterclockwise pattern from an outermost turn to an innermost turn. The second coiled part has an innermost turn that begins at an end of an innermost turn of the first coiled part and has a clockwise pattern from the innermost turn to the outermost turn of the second coiled part. Adjacent ones of the coil structures are connected by connector segments of the continuous wire.

In other exemplary embodiments, a heating element includes power rails disposed on one surface of a flexible substrate and a coil structure disposed on the other surface of the flexible substrate. Openings in the substrate expose the power rails between surfaces of the substrate. The coil structure includes a continuous strand of electrically conductive wire patterned as a first coiled part and a second coiled part as described above. One segment of the wire is electrically connected to one of the power rails through one of the openings, and another segment of the wire is electrically connected to the other power rail through another one of the openings.

FIG. 1 shows a front-side view of a heating element 100 according to one example. The exemplary heating element includes multiple coil structures disposed on one surface of a flexible substrate 102. The flexible substrate can be any material suitable for the intended application and capable of withstanding the heat from the coil structures. Examples of flexible substrates include polyimide, polyester, etc. The coil structures can be attached to the substrate by a layer of silicone-based adhesive, acrylic-based adhesive, or a B-stage adhesive, for example.

The multiple coil structures are patterned from a continuous strand of electrically conductive wire. The wire has a circular cross-section orthogonal to a length of the wire. An individual one of the coil structures is illustrated by the continuous strand of wire 104 within the area 106 bounded by dashed lines, and another one of the coil structures is illustrated by the wire within the area 108 bounded by dashed lines.

Each coil structure has a first coiled part and a second coiled part. The segment of wire of the first coiled part forms a counterclockwise pattern from the outermost turn to the innermost turn of the first coiled part. The segment of wire of the second coiled part has an innermost turn that begins at an end of an innermost turn of the first coiled part, and the segment of wire of the second coiled part forms a clockwise pattern from the innermost turn of the second coiled part to the outermost turn of the second coiled part. Alternatively stated, the turns of the second coiled part are disposed between turns of the first coiled part (or vice versa).

For purposes of illustration, the first coiled part of the coil structure within area 106, has an outermost turn that begins at location 110 and an innermost turn that ends at location 112. The innermost turn of the second coiled part begins at location 112, and the turns of the second coiled part form a clockwise pattern from the innermost turn to the outermost turn of the second coiled part, which ends at location 114. The alternating turns of the first coiled part are shown by reference numbers 116. 118, 120, and 122. Reference number 116 points to a location on the outermost turn of the first coiled part, reference number 118 points to a location on the outermost turn of the second coiled part, reference number 120 points to a location on the innermost turn of the first coiled part, and reference number 122 points to a location on the innermost turn of the second coiled part.

In the exemplary pattern, a result of the elongated shape of the coils is that portions of the innermost turn of the first coiled part do not alternate with portions of the innermost turn of the second coiled part. For example, the segments of the wire at locations 124 and 126 are part of the innermost turn of the first coiled part, and the segments of the wire at locations 128 and 130 are part of the innermost turn of the second coiled part.

Though the first coiled part and the second coiled part are described as having counterclockwise, and clockwise patterns, respectively, it will be recognized that the first coiled part could have a clockwise pattern, and the second coiled part could have a counterclockwise pattern depending on the orientation of the substrate and the position of the coil structure in a layout of multiple coil structures.

The multiple coil structures of the heating element 100 illustrate the flexibility provided by the disclosed approaches for making heating elements of different sizes. Heating elements having more or fewer coil structures can be easily constructed depending on application requirements. In a basic form, a heating element can include a single coil structure.

According to the disclosed approaches, a heating element can be made by laying a continuous strand of wire on a substrate following a path such as that illustrated by the coil structures in FIG. 1. Coil structures for numerous heating elements can be formed very quickly on a roll-to-roll web by laying a continuous strand of wire consistent with the illustrated pattern. An additional benefit of the continuous wire and the patterns disclosed herein is that adjacent coil structures are connected to one of the power rails through the same window at adjacent points on the power rail. The connection structure makes the electric potential between the coil structures approximately equal, which reduces the risk of an adverse thermal event should a short occur between adjacent coil structures.

The substrate can be fully or partially covered by an adhesive layer to which the wire can be attached. The pattern can be formed by laying wire in one pass beginning with either wire end 132 or wire end 134. A wire dispensing head can follow a path shown by the continuous pattern, dispensing wire as the wire is adhered to the adhesive layer on the substrate. Suitable material for the wire can include, for example, nickel-chromium (NiCr) alloy, iron-chrome-aluminium (FeCrAl) alloy, copper-nickel (CuNi) alloy, platinum, aluminum, or copper.

It will be appreciated that wire as used herein does not refer to printed or printed and/or etched patterns of conductive material. Rather, as used herein, wire refers to one or more strands of conductive material having a circular cross-section and that can be made, for example, by drawing the conductive material through draw plates.

In one embodiment, the conductor is a fine gauge bare or jacketed wire. For example, 44 gauge (AWG) wire has been found to be suitable for some implementations. The wire can be adhered to the surface of the substrate by a pressure-sensitive polymer adhesive. The adhesive is pressure sensitive keeps the wire in place as the pattern is formed.

The direction of the wire route (clockwise or counterclockwise) in the last-formed turn of one coil structure to the first formed turn of an adjacent coil structure is the same. For example, if laying wire begins at the location indicated by wire end 132, the first coiled part of the first coil structure is laid in a counterclockwise direction, and the second coiled part is laid in a clockwise direction. The adjacent coil structure begins at location 136, and the wire is laid in a clockwise direction to form the first coiled part and in a counterclockwise direction to form the second coiled part. The next coil structure begins at location 110, and the wire is laid in a counterclockwise direction to form the first coiled part and so on.

The continuous wire pattern includes connector segments of wire between adjacent ones of the coil structures. For example, the connector segment that connects the coil structure in area 106 to the coil structure in area 108 is the portion of wire between locations 114 and 138. The end portions of adjacent outermost turns of coiled parts of the coil structures are connected by a connector segment.

The coiled parts of the coil structures of heating element 100 include undulated segments that are connected by arced segments. The elongated shape makes maximum use of the space provided by the substrate, and the undulated segments help to avoid degradation of the structure that may result from expansion and contraction that accompanies heating and cooling of the wire.

In one embodiment, the heating element can be connected to DC power at ends 132 and 134 of the wire. In an alternative embodiment, power rails can be attached to the substrate for connecting to DC power. The heating element 100 has power rails 140 and 142 attached to the surface of the substrate 102 opposite the surface to which the wire 104 is attached. The former embodiment (not shown) would not have the power rails attached to the substrate or openings in the substrate for electrically connecting the coil structures to the power rails. In another embodiment, the wire forming the coil structures can be non-jacketed, and the power rails and the coil structures can be attached to the same surface of the flexible substrate.

The power rails can be disposed proximate edges of the substrate, and the coil structures can be disposed between the power rails. For example, power rail 140 is disposed proximate and parallel to edge 144, and power rail 142 is disposed proximate and parallel to edge 146. The power rails can be attached to the substrate by a pressure-sensitive adhesive, epoxy, or other adhesive, for example.

The pattern of coil structures and placement of the power rails allows the coil structures to be connected in a parallel circuit, or serially if desired. Heating element 100 shows a parallel connection.

The coil structures can be connected to the power rails through openings in the substrate. For example, the coil structures can be connected to power rail 140 through openings 148, 150, 152, 154, 156, and 158, and connected to power rail 142 through openings 160, 162, 164, 166, 168, and 170. Each coil structure has two ends. One end is proximate one edge of the substrate, enabling connection to one of the power rails, and the other end is proximate the other edge of the substrate, enabling connection to the other power rail. For example, the coil structure in area 106 has one end connected to power rail 140 through opening 150, and another end connected to power rail 142 through opening 162. Note that the coil structure in area 106 and the coil structure in area 108 are both connected to the power rail 140 through the opening 162 by the connector segment of wire that connects the two coil structures.

Figure 2:
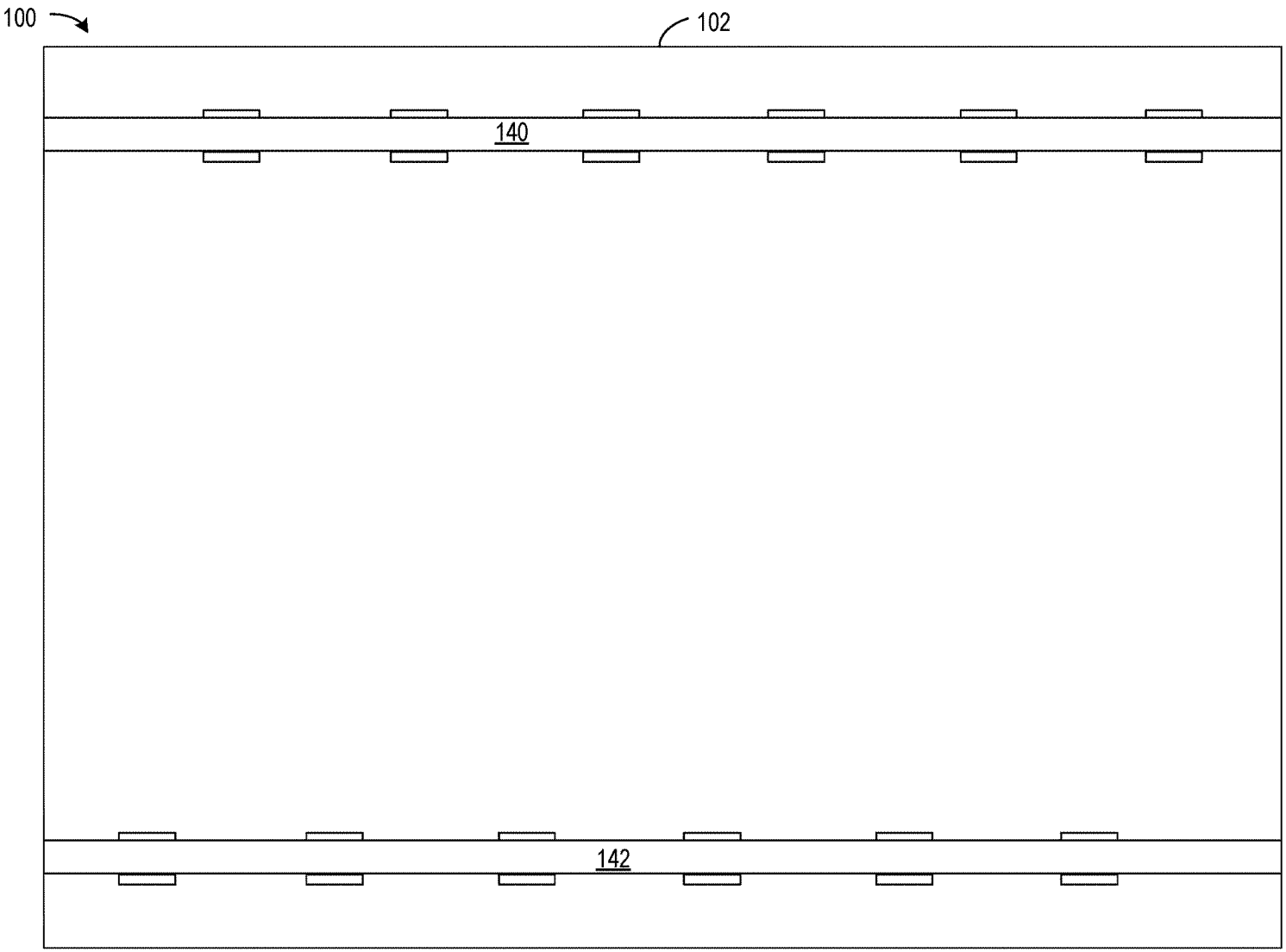
FIG. 2 shows a back-side view of the heating element of FIG. 1.

FIG. 2 shows a back-side view of the heating element 100 of FIG. 1. Power rails 140 and 142 are attached to the surface of the substrate 102 opposite the surface to which the coil structures are attached.

Figure 3:
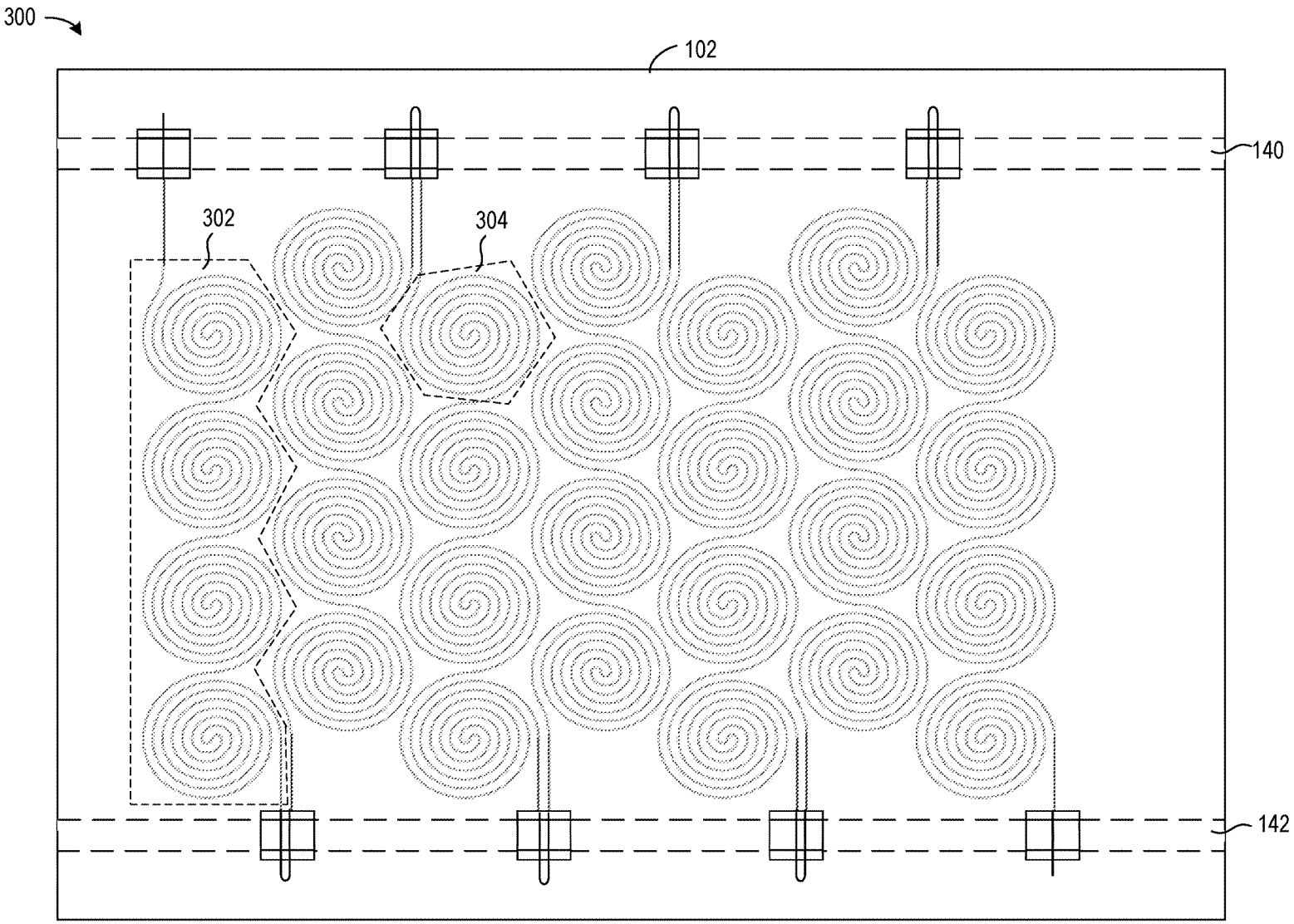
FIG. 3 shows a front-side view of a heating element according to another example.

FIG. 3 shows a front-side view of a heating element 300 according to another example. The shapes of the coil structures are circular rather than elongated as in heating element 100, and multiple coil structures are disposed in a columnar arrangement between the power rails 140 and 142. Each column includes multiple coil structures, and multiple columns of coil structures can be disposed between the power rails. A column of coil structures is illustrated within area 302 bounded by dashed lines. An individual coil structure is illustrated within the area 304 bounded by dashed lines. The heating element 300 differs from the heating element 100 in FIG. 1 in the shape of the coil structures and the columnar arrangement of coil structures. Other features of heating element 100 are the same in heating element 300.

The contemplated coil structures are not limited to the shapes shown in FIGS. 1 and 3. Rather the coils structures can assume almost any shape so long as the coil structures have first and second coiled parts in which the turns are arranged as described above.

Figure 4:
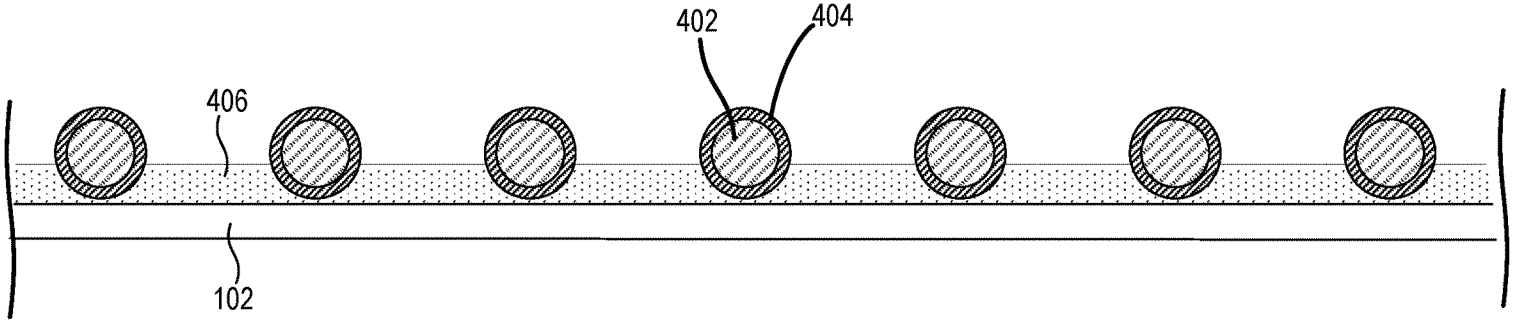
FIG. 4 shows a cross-sectional view of a portion of the heating element of FIG. 1 taken along line A.

FIG. 4 shows a cross-sectional view of a portion of the heating element 100 of FIG. 1 taken along line A. The wire 402 has a circular cross-section. The wire can be a bare wire (no insulative jacket) or a jacketed wire as shown by jacket 404. An adhesive layer 406, such as a pressure-sensitive adhesive, is disposed on the flexible substrate 102.

Figure 5:
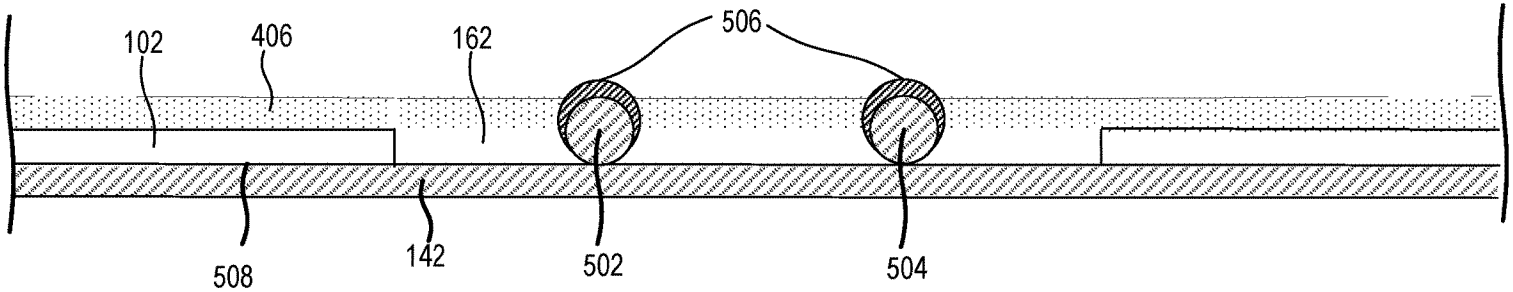
FIG. 5 shows a cross-sectional view of a portion of the heating element of FIG. 1 taken along line B.

FIG. 5 shows a cross-sectional view of a portion of the heating element 100 of FIG. 1 taken along line B. The view of FIG. 5 illustrates the portion of the heating element within opening 162. In making the opening, such as by laser cutting through the adhesive layer 406 and substrate 102, portions of the insulating jacket (FIG. 4, #404) is stripped from the wire segments 502 and 504 within the opening. The insulating jacket 506 is retained on segments of the wire shielded from the laser. The power rail 142 is laid beneath the opening on surface 508 of the substrate 102. The power rail is exposed through the opening, allowing electrical connection of the wires to the power rail. The bonding (e.g., weld, solder, conductive adhesive, etc.) of the wire to the power rail is not shown as those skilled in the art would understand the bonding without need of illustration.

Figure 6:
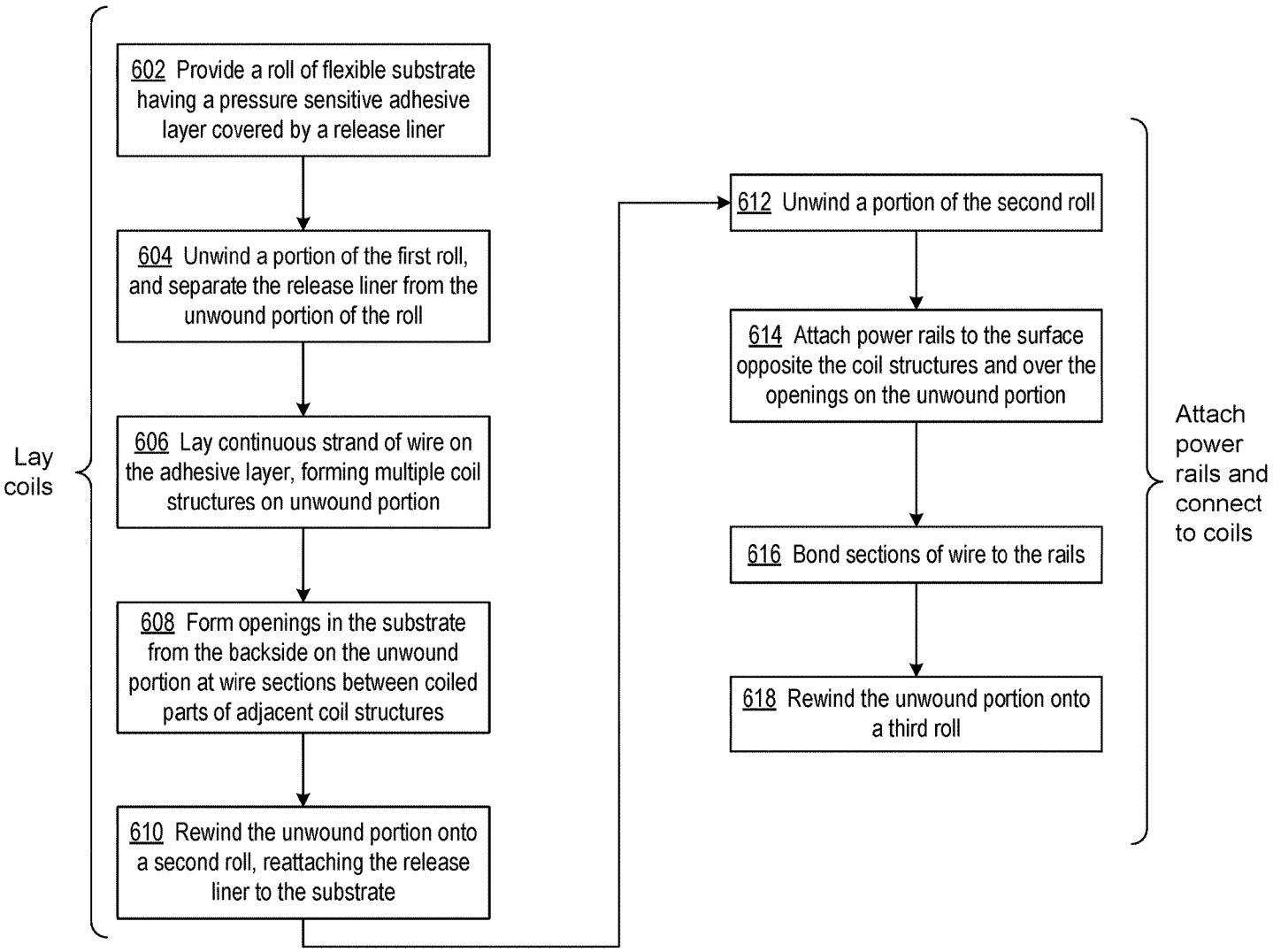
FIG. 6 is a flowchart of an exemplary process of making a roll of heater elements.

FIG. 6 is a flowchart of an exemplary process of making a roll of heater elements. The exemplary process shows two phases of roll-to-roll processing. In the first phase wire coils are laid on one side of the rolled substrate, and in the second phase the power rails are attached to the other side of the rolled substrate. Alternative flows can also be suitable.

At block 602, a roll of flexible substrate is provided. The substrate has a pressure sensitive adhesive layer covered by a release liner. At block 604, a portion of the roll is unwound, and the release liner is separated from the adhesive layer on the unwound portion of the roll.

At block 606, a continuous strand of wire is laid on the exposed adhesive layer of the unwound portion of the substrate. The laying of the wire follows the pattern of coil structures described above. The wire can be laid on the adhesive layer by pneumatic force, mechanical force, or simply drawn by the stickiness of the adhesive as wire is fed and a wire dispensing head moves over the substrate.

Openings are formed in the substrate at block 608. According to one approach, the openings are formed with a laser directed at the surface of the substrate opposite the surface on which the coil structures are disposed. The locations of the openings are as described above. Forming the openings after laying the wire on the substrate eliminates having to jump over a cutout area in the substrate when laying the wire, making attachment of the wire more predictable. Once the wire is in place, making the openings with a laser does not significantly affect the wire, other than to beneficially remove the insulating jacket on portions of the wire in the openings. Removal of the jacket allows electrical connection is to be made with the power rails when the power rails are attached. At block 610, the unrolled portion of the substrate is rewound onto another roll, reattaching the release liner to the adhesive layer in the process. The process of unwinding, laying wire, making coil structures, forming openings, and rewinding can be repeated and continued until the roll of adhesive transfer tape has been filled with heating elements.

According to the exemplary process, the power rails are attached and electrical connections made by the process at blocks 612, 614, 616, and 618. At block 612, a portion of the roll of flexible substrate having the coil structures laid thereon is unwound. At block 614, power rails are attached to the surface of the substrate opposite the coil structures and over the openings on the unwound portion. The power rails can be attached using a pressure-sensitive adhesive, epoxy, or other adhesive suitable for the intended application. The sections of wire in the openings in the substrate are bonded to the power rails at block 616. Exemplary approaches include welding or soldering the wires to the power rail. At block 618, the unwound portion of the roll is rewound onto another roll. The process of unwinding, attaching power rails, bonding, and rewinding can be repeated and continued until the end of the roll of substrate has been reached.

The disclosed heating elements can be made from flows different from the process of FIG. 6. For example, the power rails can be attached to the substrate, and the wire bonded to the power rails after forming the openings at block 608 and before rewinding the web onto another roll at block 610. In an alternative flow, the power rails can be attached before the wire is laid on the substrate. Instead of forming the openings between blocks 606 and 610, the openings could be formed between blocks 612 and 614. For heating elements in which power rails are not needed, the processing of blocks 608, 612, 614, 616, and 618 can be eliminated. For heating elements having unjacketed wire, the power rails and wire can be laid on the same surface of the substrate and openings in the substrate are unnecessary.

Figure 7:
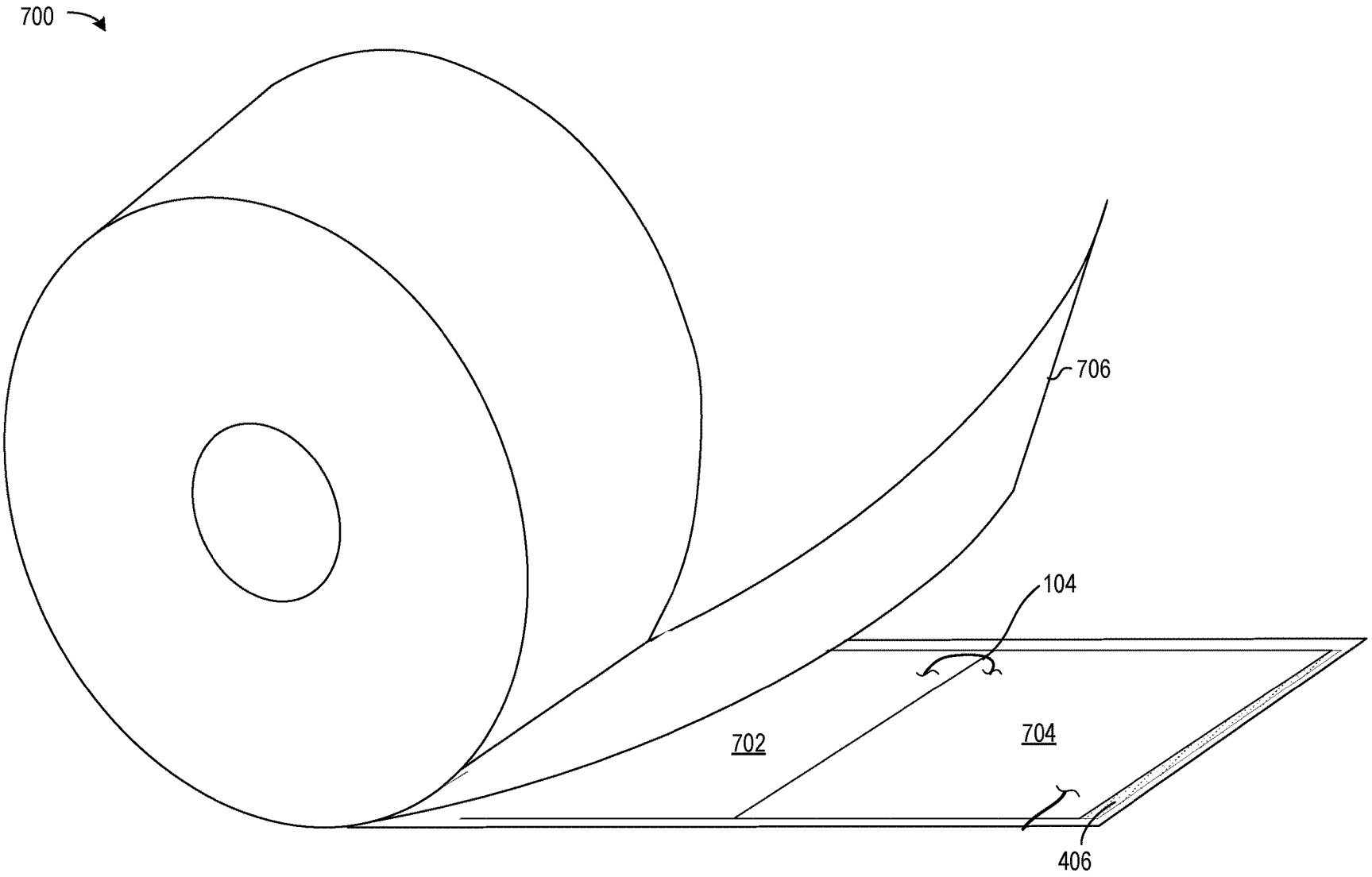
FIG. 7 shows a roll of heating elements according to one example.

FIG. 7 shows a roll 700 of heating elements according to one example. The roll can have multiple heating elements, representative examples of the heating elements are shown as blocks 702 and 704. Each heating element includes multiple coil structures (not shown) as described above. The coil structures are disposed on the adhesive layer 406. The exemplary heating elements of FIG. 7 do not include power rails on the backside of the substrate.

The spacing between sets of coil structures can ease severability of individual ones of the heating elements. For example, the set of coil structures of the heating element of FIG. 1 are closely spaced one to another. However, larger non-wired spaces are adjacent to the ends of the set. The release liner 706 allows the heating element to be delivered as a roll and can be removed at the time individual heating elements are applied to a structure to be heated or at the time the heating element is assembled with other application-specific support structure.

Figure 8:
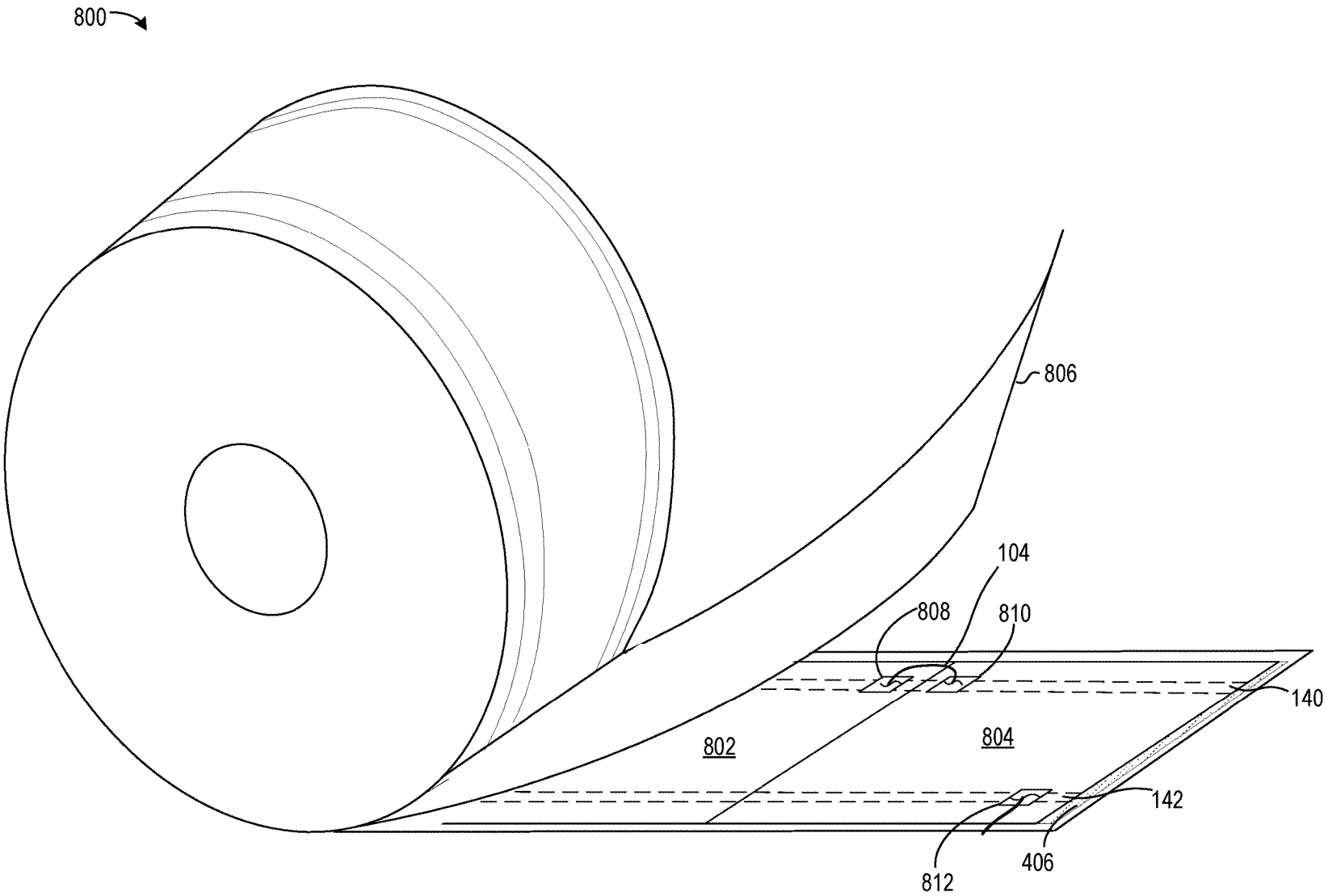
FIG. 8 shows a roll of heating elements according to another example.

FIG. 8 shows a roll 800 of heating elements according to another example. The roll can have multiple heating elements, representative examples of the heating elements are shown as blocks 802 and 804. Each heating element includes multiple coil structures (not shown) as described above. The coil structures are disposed on the adhesive layer 406. The exemplary heating elements of FIG. 8 include power rails 140 and 142 on the backside of the substrate. The exemplary roll also illustrates three openings in the substrate, though each heating element can have additional openings for connecting the coil structures to the power rails. The example openings are shown as elements 808, 810, and 812.

The spacing between sets of coil structures can ease severability of individual ones of the heating elements as described above. The release liner 806 allows the heating element to be delivered as a roll and can be removed at the time individual heating elements are applied to a structure to be heated or at the time the heating element is assembled with other application-specific support structure.

As indicated above, the illustrated shapes of the coil structures are examples, and other shapes of coil structures can be constructed to suit requirements of the intended application, such as size and heat distribution. In addition, a roll of heating elements can have two or more different shapes of coil structures. For example, a roll of heating elements can have some coil structures that have the undulated segment in the coil structure shape of FIG. 1 (or other pattern) and some coil structures that are the circular shape of FIG. 3 (or other pattern). The order of the different shapes on the roll can be any desired order as the laying of the wire can be programmatically controller. For example, if coil structure shapes are referenced as A, B, and C, the order of the shapes can be AAA . . . BBB . . . CCC; ABCABC . . . ABC; or any other sequence.

Though aspects and features may in some cases be described in individual figures, it will be appreciated that features from one figure can be combined with features of another figure even though the combination is not explicitly shown or explicitly described as a combination.

The present invention is thought to be applicable to a variety of blister package applications and particular applicable to blister packages for carrying medicine. Other aspects and embodiments of the present invention will be apparent to those skilled in the art from consideration of the specification and practice of the invention disclosed herein. It is intended that the specification and illustrated embodiments be considered as examples only, with a true scope and spirit of the invention being indicated by the following claims.

What is claimed is:

1. A heating element, comprising:

a flexible substrate having opposing first and second surfaces and a first edge and a second edge opposite the first edge;

a layer of adhesive disposed on the second surface of the substrate;

a continuous strand of electrically conductive wire disposed on the adhesive in a pattern of a plurality of coil structures, each coil structure including, respectively:

a first coiled part wherein the wire forms a counter-clockwise pattern from an outermost turn to an innermost turn of the first coiled part, and a second coiled part having an innermost turn beginning at an end of the innermost turn of the first coiled part and wherein the wire forms a clockwise pattern from the innermost turn of the second coiled part to an outermost turn of the second coiled part;

a first power rail and a second power rail disposed on the flexible substrate proximate the first edge and the second edge, respectively; and wherein the plurality of coil structures are disposed between and coupled to the first power rail and the second power rail, and for each of one or more first coil structures of the plurality of coil structures that is adjacent to a respective second coil structure of the plurality of coil structures, a connector segment of the wire connects an end portion of the outermost turn of the second coiled part of the first coil structure to an end portion of the outermost turn of the first coiled part of the respective second coil structure.

2. The heating element of claim 1, wherein:

each turn of the first coiled part includes undulated segments connected by arced segments; and each turn of the second coiled part includes undulated segments connected by arced segments.

3. The heating element of claim 1, wherein the first coiled part and the second coiled part are circular.

4. The heating element of claim 1, wherein the pattern of the plurality of coil structures includes a plurality of columns of two or more coil structures.

5. The heating element of claim 4, wherein each first coiled part and each second coiled part are circular.

6. The heating element of claim 1, wherein the first power rail and the second power rail are disposed on the first surface of the flexible substrate and the heating element further comprising:

a plurality of openings in the substrate exposing the first power rail and the second power rail through the second surface; and wherein each connector segment is electrically connected to one of the first power rail or the second power rail through one of the plurality of openings.

7. The heating element of claim 6, wherein:

the first power rail is parallel to the first edge; and the second power rail is parallel to the second edge.

8. The heating element of claim 6, wherein:

each turn of the first coiled part includes undulated segments connected by arced segments; and each turn of the second coiled part includes undulated segments connected by arced segments.

9. The heating element of claim 1, wherein the wire is bare wire, the first power rail and the second power rail are disposed on the second surface of the flexible substrate, and each connector segment is electrically connected to one of the first power rail or the second power rail.

10. The heating element of claim 1, wherein the wire is bare wire.

11. The heating element of claim 1, wherein the wire is jacketed wire.

12. The heating element of claim 1, wherein the wire has a circular cross-section orthogonal to a length of the wire.

13. The heating element of claim 12, wherein the wire includes one of nickel-chromium (NiCr) alloy, iron-chrome-aluminium alloy, copper-nickel alloy, platinum, aluminum, or copper.

14. The heating element of claim 1, wherein the plurality of coil structures are connected in series between the first power rail and the second power rail.

15. The heating element of claim 1, wherein the plurality of coil structures are connected in parallel between the first power rail and the second power rail.

16. The heating element of claim 1, wherein the plurality of coil structures are bonded to the first power rail and the second power rail by one of solder, welds, or conductive adhesive.

17. A roll of heating elements, comprising:

a flexible substrate having opposing first and second surfaces and a first edge and a second edge opposite the first edge;

an adhesive layer disposed on the second surface of the substrate;

a continuous strand of electrically conductive wire disposed on the second surface in a pattern of a plurality of coil structures, each coil structure including, respectively:

a first coiled part wherein the wire forms a counter-clockwise pattern from an outermost turn to an innermost turn of the first coiled part, and a second coiled part having an innermost turn beginning at an end of the innermost turn of the first coiled part and wherein the wire forms a clockwise pattern from an innermost turn of the second coiled part to the outermost turn of the second coiled part;

a release liner adhered to the adhesive layer and covering the plurality of coil structures;

a first power rail and a second power rail disposed on the flexible substrate proximate the first edge and the second edge, respectively;

wherein the plurality of coil structures are disposed between and coupled to the first power rail and the second power rail, and for each of one or more first coil structures of the plurality of coil structures that is adjacent to a respective second coil structure of the plurality of coil structures, a connector segment of the wire connects an end portion of the outermost turn of the second coiled part of the first coil structure to an end portion of the outermost turn of the first coiled part of the respective second coil structure; and wherein the flexible substrate, adhesive layer, and plurality of coil structures are coiled into the roll.

18. The roll of heating elements of claim 17, wherein:

each turn of the first coiled part includes undulated segments connected by arced segments; and each turn of the second coiled part includes undulated segments connected by arced segments.

19. The roll of heating elements of claim 17, wherein the first coiled part and the second coiled part are circular.

20. The roll of heating elements of claim 17, wherein the pattern of the plurality of coil structures includes a plurality of columns of two or more coil structures.

21. The roll of heating elements of claim 20, wherein each first coiled part and each second coiled part are circular.

22. The roll of heating elements of claim 17, wherein the wire is bare wire.

23. The roll of heating elements of claim 17, wherein the wire is jacketed wire.

24. The roll of heating elements of claim 17, wherein the first power rail and the second power rail are disposed on the first surface of the flexible substrate, and the roll of heating elements further comprising:

a plurality of openings in the substrate exposing the first power rail and the second power rail through the second surface; and wherein each connector segment is electrically connected to one of the first power rail or the second power rail through one of the plurality of openings.

25. The roll of heating elements of claim 17, wherein the wire is bare wire, the first power rail and the second power rail are disposed on the second surface of the flexible substrate, and each connector segment is electrically connected to one of the first power rail or the second power rail.

26. The roll of heating elements of claim 17, wherein the plurality of coil structures include a plurality of coil structures having a first shape and a plurality of coil structures having a second shape, and the first shape is different from the second shape.

27. The roll of heating elements of claim 17, wherein the plurality of coil structures are connected in series between the first power rail and the second power rail.

28. The roll of heating elements of claim 17, wherein the plurality of coil structures are connected in parallel between the first power rail and the second power rail.

29. The roll of heating elements of claim 17, wherein the plurality of coil structures are bonded to the first power rail and the second power rail by one of solder, welds, or conductive adhesive.

30. A method, comprising:

providing a roll of flexible substrate having opposing first and second surfaces a first edge and a second edge opposite the first edge, and an adhesive layer disposed on the second surface and covered by a release liner;

unwinding a portion of the roll;

separating the release liner from the substrate as the portion of the roll is unwound;

attaching a first power rail and a second power rail to the first surface of the flexible substrate on the unwound portion;

laying a continuous strand of electrically conductive wire on the adhesive layer of the unwound portion in a pattern of a plurality of coil structures, each coil structure including, respectively:

a first coiled part wherein the wire forms a counter-clockwise pattern from an outermost turn to an innermost turn of the first coiled part, and a second coiled part having an innermost turn beginning at an end of the innermost turn of the first coiled part and wherein the wire forms a clockwise pattern from an innermost turn of the second coiled part to the outermost turn of the second coiled part; and wherein the laying includes, forming the plurality of coil structures between the first power rail and the second power rail, coupling the plurality of coil structures to the first power rail and the second power rail, and for each of one or more first coil structures of the plurality of coil structures that is adjacent to a respective second coil structure of the plurality of coil structures, laying a connector segment of the wire from an end portion of the outermost turn of the second coiled part of the first coil structure to an end portion of the outermost turn of the first coiled part of the respective second coil structure; and rewinding the unwound portion of the roll and reattaching the release liner to the adhesive layer as the roll is rewound.

31. The method of claim 30, further comprising:

forming a plurality of openings in the substrate exposing each connector segment through the second surface;

attaching the first power rail and the second power rail to the first surface of the flexible substrate on the unwound portion; and connecting each connector segment to one of the first power rail or the second power rail through one of the plurality of openings.

32. The method of claim 30, further comprising:

wherein the wire is bare wire;

attaching the first power rail and the second power rail to the second surface of the flexible substrate on the unwound portion; and connecting each connector segment to one of the first power rail or the second power rail.

* * * * *